US010431886B2

(12) United States Patent
Hsu et al.

(10) Patent No.: US 10,431,886 B2
(45) Date of Patent: Oct. 1, 2019

(54) NETWORK MONITORING DEVICE

(71) Applicants: LITE-ON ELECTRONICS (GUANGZHOU) LIMITED, Guangzhou (CN); LITE-ON TECHNOLOGY CORPORATION, Taipei (TW)

(72) Inventors: Cheng-Hsuan Hsu, Taipei (TW); Ching-Wei Tsai, Taipei (TW); Ming-Wei Wang, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 144 days.

(21) Appl. No.: 15/700,229

(22) Filed: Sep. 11, 2017

(65) Prior Publication Data

US 2018/0123230 A1 May 3, 2018

(30) Foreign Application Priority Data

Oct. 27, 2016 (CN) ..... 2016 1 0955314

(51) Int. Cl.

| | |
|---|---|
| ***H01Q 1/42*** | (2006.01) |
| ***H01Q 1/40*** | (2006.01) |
| ***H01Q 1/00*** | (2006.01) |
| ***H01Q 1/22*** | (2006.01) |
| ***H01Q 9/28*** | (2006.01) |
| ***H01Q 9/42*** | (2006.01) |
| ***H01Q 21/28*** | (2006.01) |

(52) U.S. Cl.

CPC ..... *H01Q 1/425* (2013.01); *H01Q 1/007* (2013.01); *H01Q 1/2283* (2013.01); *H01Q 1/40* (2013.01); *H01Q 9/285* (2013.01); *H01Q 9/42* (2013.01); *H01Q 21/28* (2013.01)

(58) Field of Classification Search

CPC ..... H01Q 1/425; H01Q 1/007; H01Q 1/2283; H01Q 1/40; H01Q 9/42; H01Q 21/28

See application file for complete search history.

(56) References Cited

U.S. PATENT DOCUMENTS

| | | | | |
|---|---|---|---|---|
| D748,709 | S * | 2/2016 | Jeong | D16/202 |
| 2010/0289703 | A1* | 11/2010 | Huang | H01Q 9/04 343/702 |
| 2014/0361933 | A1* | 12/2014 | Zhang | H01Q 1/243 343/702 |
| 2017/0365919 | A1* | 12/2017 | Hovmoller | H01Q 5/30 |

* cited by examiner

*Primary Examiner* — Dameon E Levi
*Assistant Examiner* — David E Lotter
(74) *Attorney, Agent, or Firm* — McClure, Qualey, & Rodack, LLP

(57) ABSTRACT

A network monitoring device including a metal casing, an antenna and a feeding point is provided. The metal casing has an outer lateral surface. The antenna is disposed on the outer lateral surface and electrically connected to the metal casing. The feeding point is disposed on the antenna.

12 Claims, 6 Drawing Sheets

NETWORK MONITORING DEVICE

This application claims the benefit of People's Republic of China application Serial No. 201610955314.6, filed Oct. 27, 2016, the subject matter of which is incorporated herein by reference.

BACKGROUND OF THE INVENTION

Field of the Invention

The invention relates in general to a network monitoring device, and more particularly to a wireless networked network monitoring device with antenna.

Description of the Related Art

Most casings of wireless networked products are made of insulating plastics in order to avoid wireless signals being affected by the casing. However, the plastic casing is subjected to certain restrictions. For example, the plastic casing has poor performance in terms of waterproof, impact resistance, weather resistance, environmental damage resistance and heat dissipation. Therefore, it has become a prominent task for the industry to provide a new technology capable of resolving the said problems.

SUMMARY OF THE INVENTION

The invention is directed to a network monitoring device capable of resolving the said problems.

According to one embodiment of the present invention, a network monitoring device is provided. The network monitoring device includes a metal casing, a first antenna and a first feeding point. The metal casing has a first outer lateral surface. The first antenna is disposed on the first outer lateral surface and electrically connected to the metal casing. The first feeding point is disposed on the first antenna.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1A:
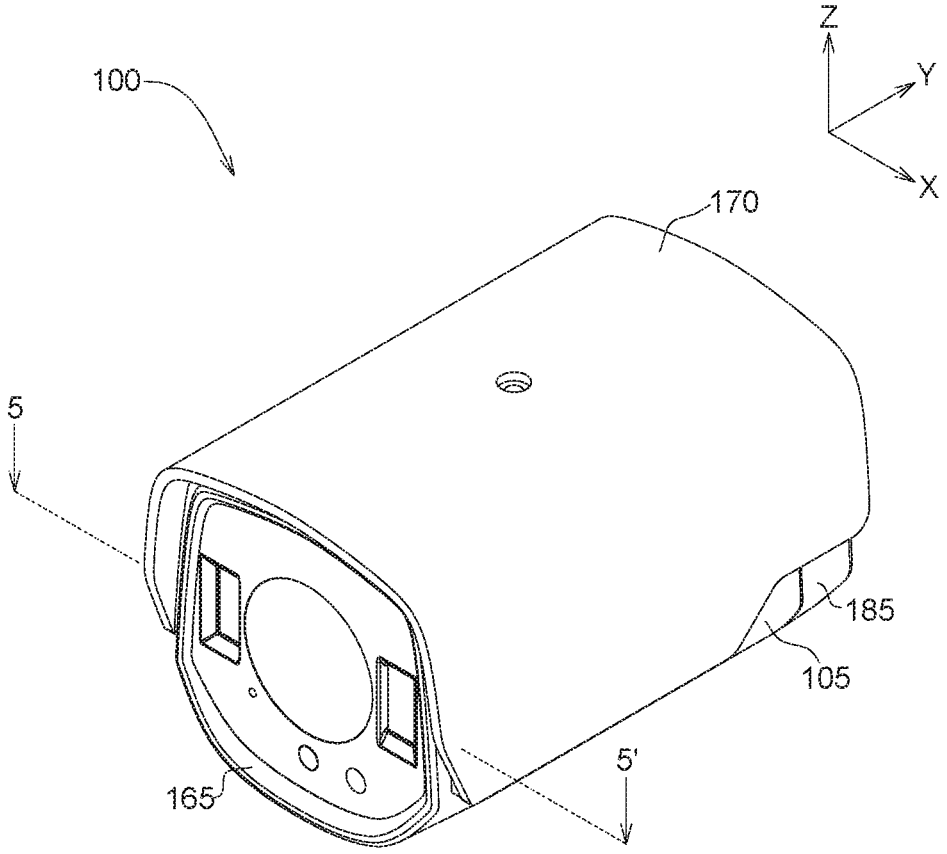
FIG. 1A is an external view of a network monitoring device according to the present invention an embodiment.
Figure 1B:
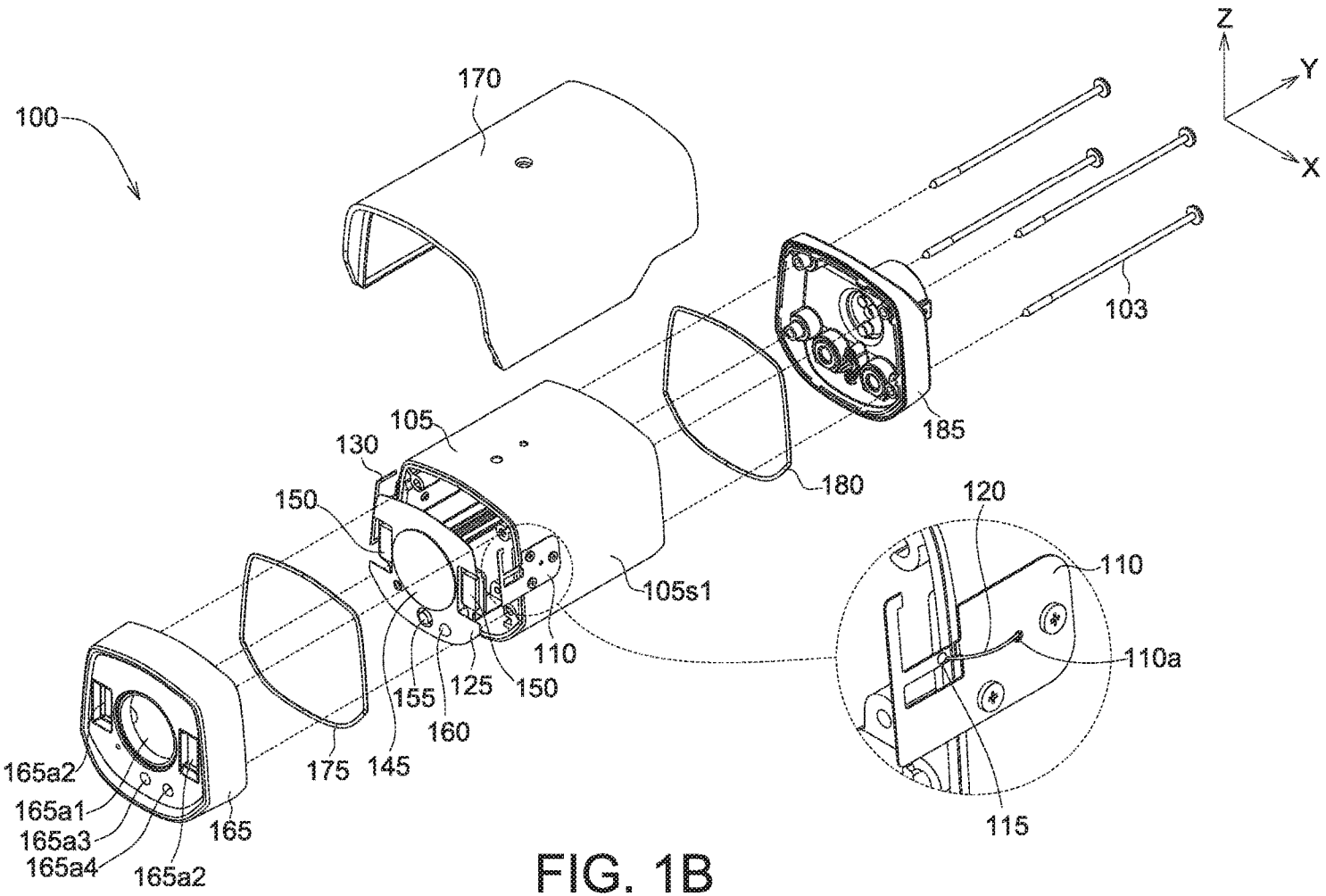
FIGS. 1B and 1C are explosion diagrams of the network monitoring device of FIG. 1A.
Figure 1C:
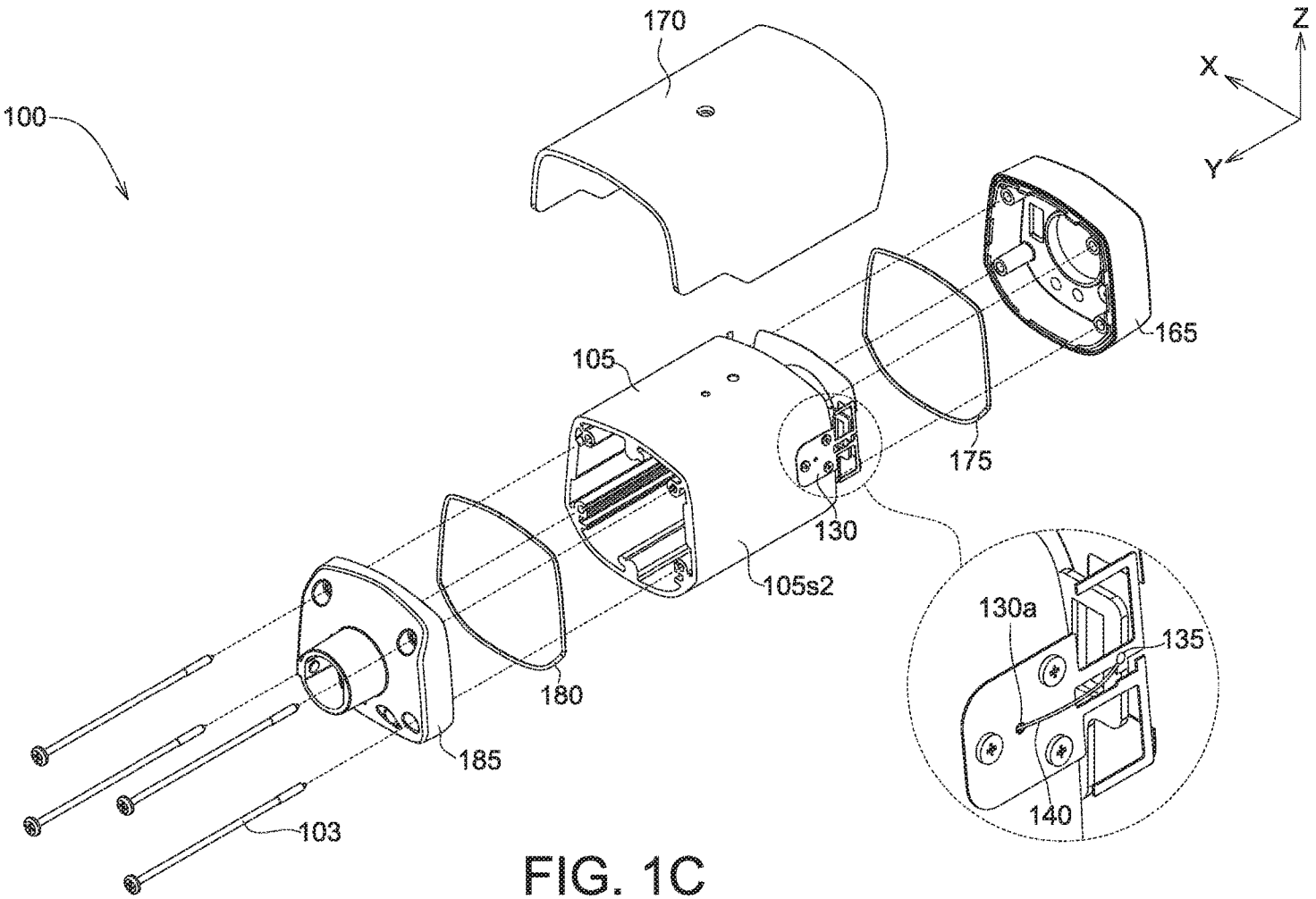

Refer to FIGS. 1A, 1B and 1C. FIG. 1A is an external view of a network monitoring device 100 according to an embodiment of the present invention. FIGS. 1B and 1C are explosion diagrams of the network monitoring device 100 of FIG. 1A.

The network monitoring device 100 can be realized by a network monitor (IP cam), a doorbell, or other types of monitors. The network monitoring device 100 can be a fixed-type network monitoring device, or can be disposed on a transport vehicle and move with the transport vehicle. The network monitoring device 100 can be disposed in an outdoor or an indoor environment.

The network monitoring device 100 includes multiple fixing members 103, the metal casing 105, a first antenna 110, a first feeding point 115, a first feeding line 120, a circuit board 125, a second antenna 130, a second feeding point 135, a second feeding line 140, a camera lens 145, two infra-red emitters 150, an ambient light sensor (ALS) 155, an object sensor 160, a front cover 165, a cover 170, a first sealing ring 175, a second sealing ring 180 and a rear cover 185.

The fixing members 103 pass through the rear cover 185 and the metal casing 105 to be fixed to the front cover 165 for fixing relative positions among the metal casing 105, the rear cover 185 and the front cover 165. The fixing members 103 have threads and can be realized by such as bolts. The cover 170 is disposed on the metal casing 105 and covers a portion of the metal casing 105, the first antenna 110, the first feeding point 115, the first feeding line 120, the second antenna 130, the second feeding point 135 and the second feeding line 140. The cover 170 can be realized by an insulating cover to avoid interfering with or shielding the signals transmitted or received by the first antenna 110 and the second antenna 130 and reducing the damage caused to the first antenna 110 and the second antenna 130 by the external environment (such as sunlight, rainwater, and impurities). In another embodiment, the network monitoring device 100 can omit the cover 170.

The metal casing 105 has a first outer lateral surface 105*s*1 and a second outer lateral surface 105*s*2 disposed oppositely. The first antenna 110 and the second antenna 130 are disposed on the first outer lateral surface 105*s*1 and the second outer lateral surface 105*s*2 respectively, and are exposed outside the metal casing 105. Thus, the signals transmitted or received by the first antenna 110 and the second antenna 130 will not be shielded by the metal casing 105. Besides, the first antenna 110 and the second antenna 130 can emit radio frequency (RF) signals, Wi-Fi signals or wireless signals using other communication protocols.

The first antenna 110 is electrically connected to the metal casing 105. The first feeding point 115 is disposed on the first antenna 110 and electrically connected to the circuit board 125 through the first feeding line 120, wherein the circuit board 125 is disposed inside the metal casing 105. As indicated in FIG. 1B, the first feeding point 115 is located on an outer lateral surface of the first antenna 110, the first feeding line 120 extends to the interior of the metal casing 105 from the first feeding point 115 and passes through the via hole 110*a* of the first antenna 110 to be electrically connected to the circuit board 125. Since the metal casing 105 is electrically connected to the first antenna 110 and the entire metal casing 105 is used as a grounding portion of the first antenna 110, the radiation field pattern of the network monitoring device 100 becomes omnidirectional. Specifically, since the first antenna 110 contacts the outer surface of the metal casing 105 and the metal casing 105 is grounded, the metal casing 105 does not shied the signals transmitted or received by the first antenna 110 and even makes the radiation field pattern of the network monitoring device 100 omnidirectional. Moreover, the metal casing 105 can be grounded through the circuit board 125 or a ground wire.

Besides, the second antenna 130 is electrically connected to the metal casing 105. The second feeding point 135 is disposed on the second antenna 130 and electrically connected to the circuit board 125 through the second feeding line 140. As indicated in FIG. 1C, the second feeding point 135 is located on an outer lateral surface of the second antenna 130; the second feeding line 140 extends to the metal casing 105 from the second feeding point 135 and passes through the via hole 130*a* of the second antenna 130 to be electrically connected to the circuit board 125. Since the metal casing 105 is electrically connected to the second antenna 130 and the entire metal casing 105 is used as a grounding portion of the second antenna 130, the field pattern of the network monitoring device 100 becomes omnidirectional. In the present embodiment, the first antenna 110 has a geometric pattern different from that of the second antenna 130, so that the field pattern of the first antenna 110 and the field pattern of the second antenna 130 complement each other, and the field pattern of the network monitoring device 100 becomes even more omnidirectional. In another embodiment, the geometric pattern of the first antenna 110 can be identical or similar to that of the second antenna 130.

Figure 2A:
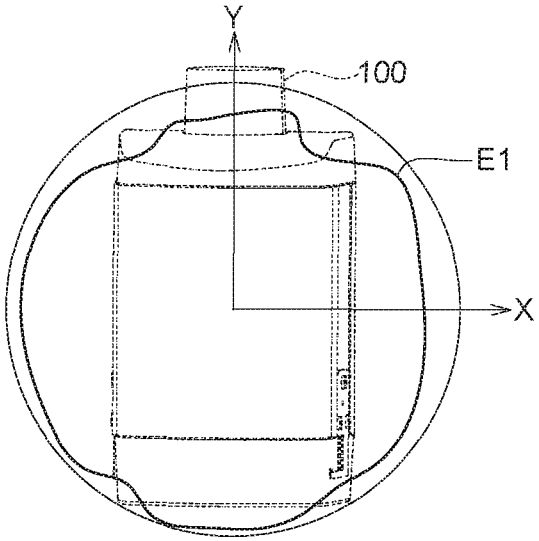
FIGS. 2A and 2B are radiation field patterns of the network monitoring device of FIG. 1.
Figure 2B:
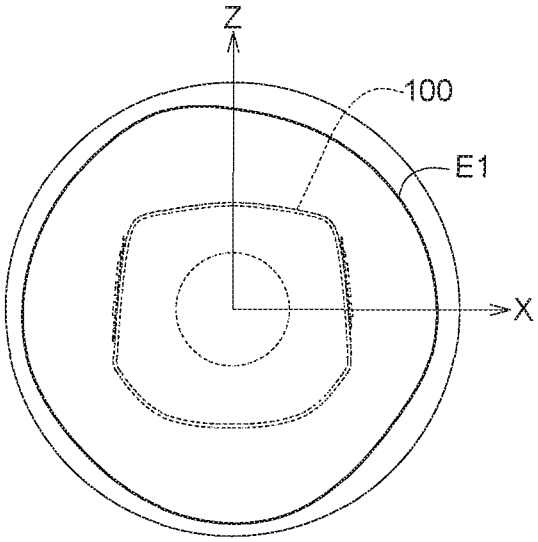

Refer to FIGS. 2A and 2B, radiation field patterns of the network monitoring device 100 of FIG. 1 are shown. Since the entire metal casing 105 is used as a grounding portion of both the first antenna 110 and the second antenna 130, the field pattern E1 of the network monitoring device 100 is nearly omnidirectional. Furthermore, the first antenna 110 and the second antenna 130 both have a gain of about 3.15 dBi. Due to the design of the first antenna 110 and the second antenna 130, the network monitoring device 100 provides a working band of 2.4 GHz-2.5 GHz.

The metal casing 105 may be made of a material including aluminum, iron or other conductive materials. The metal casing 105 is made of a metal having better strength and hardness than the polymeric material, and therefore can be used in the outdoor environment. The metal casing 105 has better heat dissipation capacity than the insulating polymeric material. In terms of the manufacturing process, the metal casing 105 can be formed by way of extrusion, casting or machining. Also, the first antenna 110 and the second antenna 130 can be fixed to an outer lateral surface of the metal casing 105 using a screwing or a soldering method. As indicated in FIGS. 1B and 1C, the first outer lateral surface 105*s*1 and the second outer lateral surface 105*s*2 respectively are two opposite lateral surfaces of the metal casing 105. In another embodiment, the first outer lateral surface 105*s*1 and the second outer lateral surface 105*s*2 can be two adjacent outer lateral surfaces of the metal casing 105. Besides, the quantity of antennas of the network monitoring device 100 can be less than or greater than two. For example, the network monitoring device 100 can have one or more than two antennas, such as three or more.

As indicated in FIG. 1B, the camera lens 145, the infra-red emitter 150, the ambient light sensor 155 and the object sensor 160 can be disposed on the circuit board 125. The front cover 165 has a first opening 165*a*1, two second openings 165*a*2, a third opening 165*a*3 and a fourth opening 165*a*4, wherein the camera lens 145, the infra-red emitter 150, the ambient light sensor 155 and the object sensor 160 are exposed from the first opening 165*a*1, the second opening 165*a*2, the third opening 165*a*3 and the fourth opening 165*a*4, respectively.

The camera lens 145 can capture the image at the front by way of photography or video recording. The images captured by the camera lens 145 can be wirelessly transmitted to an external electronic device, such as a server, a display or a mobile phone, through the first antenna 110 and the second antenna 130. In another embodiment, the network monitoring device 100 may selectively omit the camera lens 145.

The infra-red emitter 150 can provide illumination during the night. The ambient light sensor 155 can detect an ambient brightness. Although it is not illustrated in the diagram, a controller (not illustrated) disposed on the circuit board 125 can turn on/off the capturing function of the camera lens 145 according to the signal of the object sensor 160 or control the infra-red emitter 150 to emit an infra-red light according to the signal of the ambient light sensor 155 to improve the clarity of night photography. The object sensor 160 can detect an external object approaching the network monitoring device 100 or the movement of the external object. When the object sensor 160 detects that an object enters a monitoring range, the controller controls the camera lens 145 to start photographing. The object sensor 160 can be realized by a passive infrared sensor (PIR), a microwave sensor or other types of sensors. The said object can be a living body, such as a human or an animal, or a non-living body.

Figure 3:
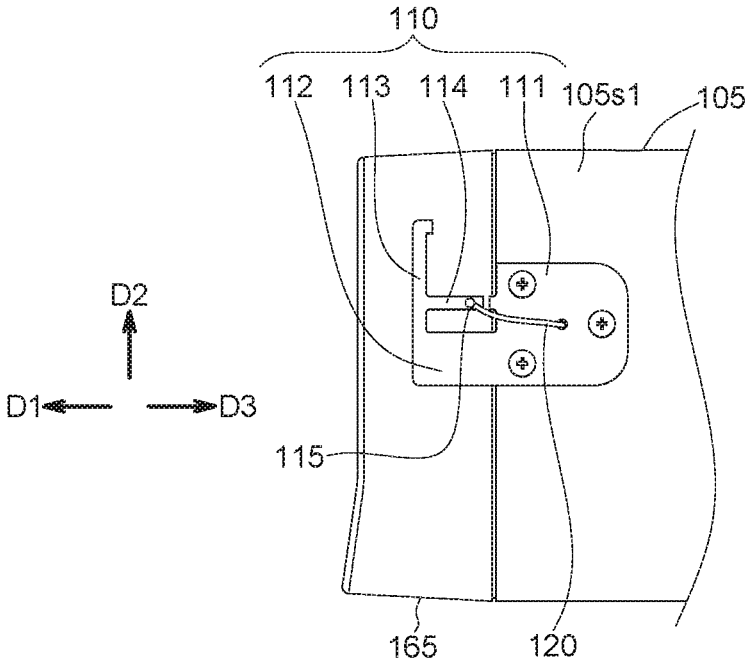
FIG. 3 is a schematic diagram of a first antenna viewed towards the first outer lateral surface of FIG. 1B.

FIG. 3 is a schematic diagram of a first antenna 110 viewed towards the first outer lateral surface 105*s*1 of FIG. 1B. The first antenna 110 includes a first grounding portion 111, a first radiating portion 112, a second radiating portion 113 and a third radiating portion 114. The first grounding portion 111 can be fixed to the first outer lateral surface 105*s*1 of the metal casing 105 using screws. The first radiating portion 112 outwardly extends from the first grounding portion 111 in a first direction D1. The second radiating portion 113 extends from the first radiating portion 112 in a second direction D2. The third radiating portion 114 extends to the first grounding portion 111 from the second radiating portion 113 in a third direction D3, but is not connected to the first grounding portion 111. That is, the third radiating portion 114 and the first grounding portion 111 are separated from each other. The second radiating portion 113 protrudes beyond the third radiating portion 114 in the second direction D2. The second direction D2, the first direction D1 and the third direction D3 are substantially perpendicular to each other. The first direction D1 and the third direction D3 are inverse to each other. The first feeding point 115 is located on the third radiating portion 114. Under the geometric design of the first antenna 110, the radiation field pattern of the network monitoring device 100 becomes omnidirectional.

Figure 4:
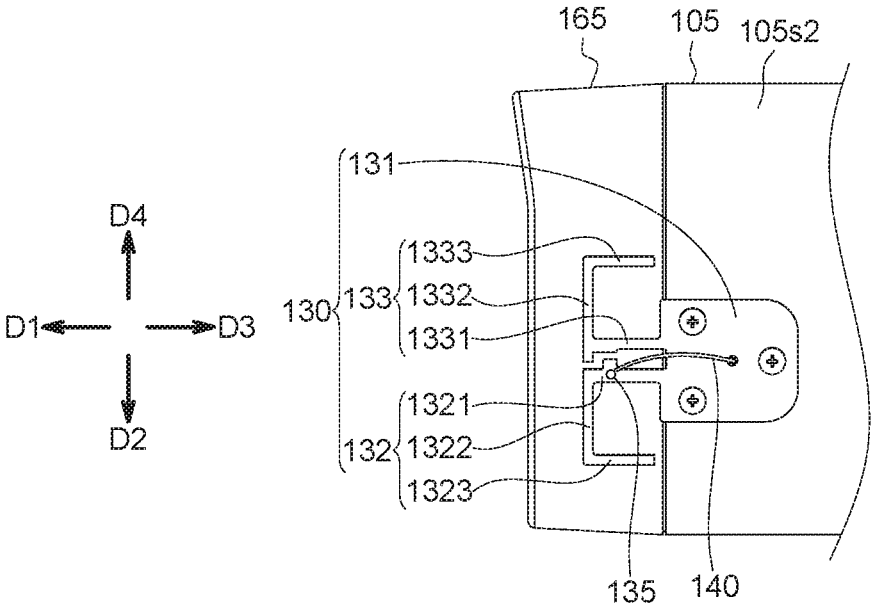
FIG. 4 is a schematic diagram of a second antenna viewed towards the second outer lateral surface of FIG. 1C.

FIG. 4 is a schematic diagram of a second antenna 130 viewed towards the second outer lateral surface 105*s*2 of FIG. 1C. The second antenna 130 includes a second grounding portion 131 and two fourth radiating portions 132 and 133, wherein the second grounding portion 131 can be fixed to a second outer lateral surface 105*s*2 of the metal casing 105 using screws, and the fourth radiating portions 132 and 133 are connected to the second grounding portion 131 and are basically arranged in a symmetric manner. The fourth radiating portion 132 includes a fifth radiating portion 1321, a sixth radiating portion 1322 and a seventh radiating portion 1323, wherein the fifth radiating portion 1321 outwards extends from the second grounding portion 131 in a first direction D1; the sixth radiating portion 1322 extends from the fifth radiating portion 1321 in a second direction D2; the seventh radiating portion 1323 extends from the sixth radiating portion 1322 in a third direction D3. Similarly, the fourth radiating portion 133 includes a fifth radiating portion 1331, a sixth radiating portion 1332 and a seventh radiating portion 1333, wherein the fifth radiating portion 1331 outwards extends from the second grounding portion 131 in the first direction D1; the sixth radiating portion 1332 extends from the fifth radiating portion 1331 in a fourth direction D4; the seventh radiating portion 1333 extends from the sixth radiating portion 1332 in the third direction D3. The second direction D2 and the fourth direction D4 are inverse to each other. The second feeding point 135 is located on the fifth radiating portion of one of the two fourth radiating portions 132. For example, the second feeding point 135 is located on the fifth radiating portion 1321 of the fourth radiating portion 132.

Figure 5:
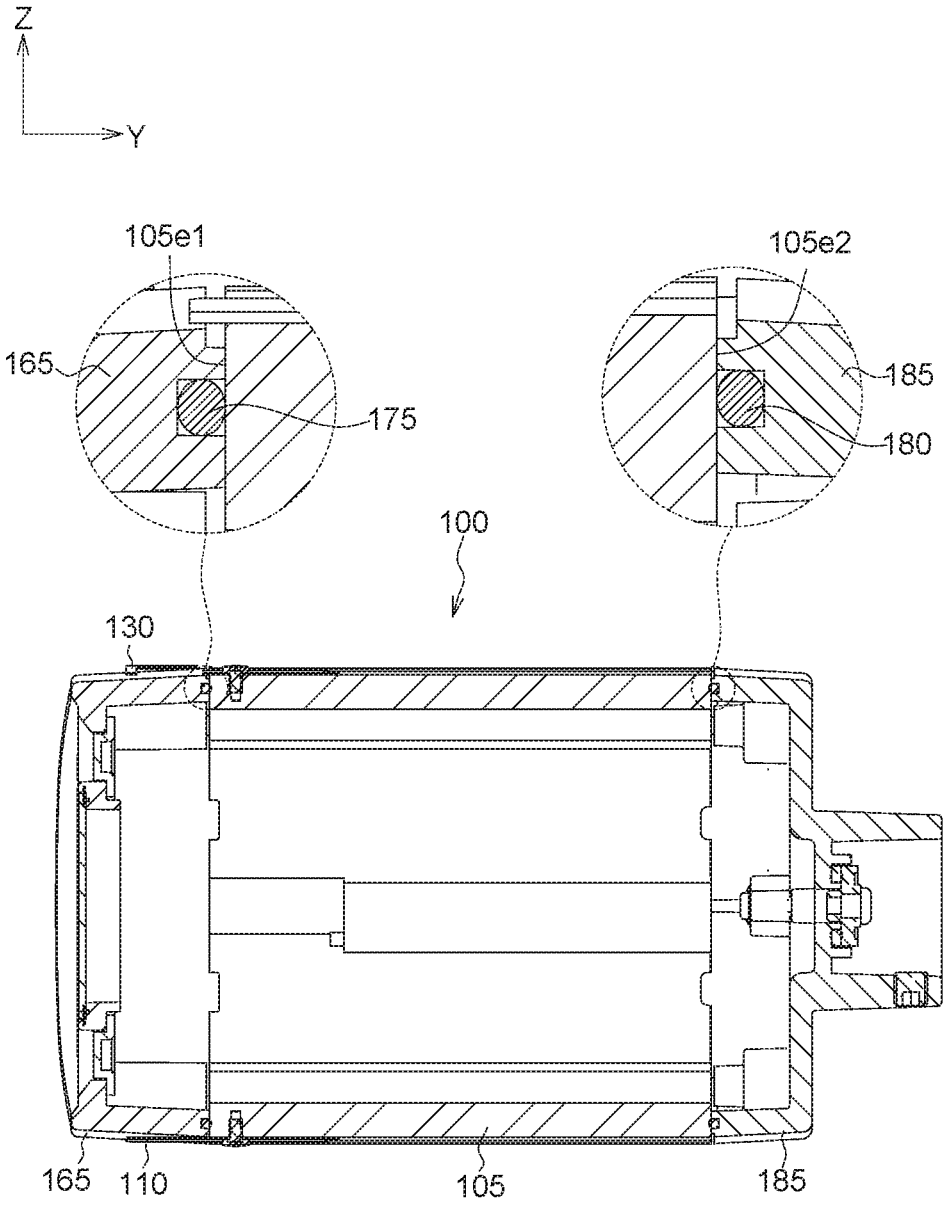
FIG. 5 is a cross-sectional view of the network monitoring device of FIG. 1A viewed along a direction 5-5'.

FIG. 5 is a cross-sectional view of the network monitoring device 100 of FIG. 1A viewed along a direction 5-5' (cover 170 is not illustrated). The metal casing 105 has a first terminal surface 105*e*1 and a second terminal surface 105*e*2 disposed oppositely. The front cover 165 is disposed on the first terminal surface 105*e*1. A portion of the first antenna 110 and a portion of the second antenna 130 protrude beyond the first terminal surface 105*e*1. For example, the radiating portion of the first antenna 110 (such as the first radiating portion 112, the second radiating portion 113 and the third radiating portion 114) and the radiating portion of the second antenna 130 (such as the fourth radiating portion 132 and 133) protrude beyond the first terminal surface 105*e*1.

The first sealing ring 175 is located between the front cover 165 and the first terminal surface 105*e*1 to seal the gap between the front cover 165 and the first terminal surface 105*e*1 of the metal casing 105 to avoid external impurities entering the network monitoring device 100 through the gap. Therefore, the network monitoring device 100 can be used in an outdoor environment. Besides, the front cover 165 can be realized by an insulating front cover to avoid affecting the signal transmission and reception of the first antenna 110 and the second antenna 130. Since front cover 165 is an isolative, the first antenna 110 and the second antenna 130 are allowed to contact the front cover 165 during the assembly process. However, in the present invention, the front cover 165 does not have to be an insulating front cover. When the front cover 165 is a metallic front cover, the front cover 165 is preferably separated from the first antenna 110 and the second antenna 130 by a distance, such as 1 cm, to reduce the negative influence caused to the signal transmission and reception of antennas by the metallic front cover.

The rear cover 185 is disposed on a second terminal surface 105*e*2. The second sealing ring 180 is located between the rear cover 185 and the second terminal surface 105*e*2 to seal the gap between the rear cover 185 and the second terminal surface 105*e*2 of the metal casing 105 and avoid external impurities entering the network monitoring device 100 through the gap. Therefore, the network monitoring device 100 can be used in an outdoor environment. Besides, the rear cover 185 can be realized by an insulating rear cover or a metal rear cover.

To summarize, the network monitoring device disclosed in above embodiments of the present invention includes a metal casing and at least an antenna electrically connected to the metal casing. The metal casing is electrically connected to a grounding potential. When the metal casing is used as a grounding portion of the antenna, the radiation field pattern of the network monitoring device becomes omnidirectional, and the larger the omnidirectional coverage, the smaller the no-signal area. The network monitoring device of the present invention embodiment uses the metal casing which has better performance in terms of waterproof, impact resistance, weather resistance, environmental damage resistance and heat dissipation than the plastic casing.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A network monitoring device, comprising:

a metal casing having a first outer lateral surface and a second outer lateral surface;

a first antenna disposed on the first outer lateral surface and electrically connected to the metal casing;

a first feeding point disposed on the first antenna;

a second antenna disposed on the second outer lateral surface and electrically connected to the metal casing; and a second feeding point disposed on the second antenna.

2. The network monitoring device according to claim 1, further comprising:

an object sensor disposed inside the metal casing.

3. The network monitoring device according to claim 1, wherein the metal casing has a terminal surface beyond which the first antenna protrudes.

4. The network monitoring device according to claim 1, wherein the metal casing has a terminal surface, and the network monitoring device further comprises: a front cover disposed on a terminal surface of the metal casing; and a sealing ring located between the front cover and the terminal surface to seal a gap between the front cover and the metal casing.

5. The network monitoring device according to claim 1, wherein the front cover is an insulating front cover.

6. The network monitoring device according to claim 1, wherein the first antenna has a geometric pattern different from that of the second antenna.

7. The network monitoring device according to claim 1, wherein the first outer lateral surface and the second outer lateral surface are two opposite outer lateral surfaces of the metal casing.

8. The network monitoring device according to claim 1, wherein the first outer lateral surface and the second outer lateral surface are two adjacent outer lateral surfaces of the metal casing.

9. The network monitoring device according to claim 1, wherein the first antenna comprises:

a first grounding portion fixed to the first outer lateral surface of the metal casing;

a first radiating portion outwards extending from the first grounding portion in a first direction;

a second radiating portion extending from the first radiating portion in a second direction; and a third radiating portion extending from the second radiating portion in a third direction;

wherein the second radiating portion protrudes beyond the third radiating portion in the second direction, the second direction and the first direction are substantially perpendicular to each other, the first direction and the third direction are inverse to each other, and the first feeding point is located on the second radiating portion.

10. The network monitoring device according to claim 1, wherein the second antenna comprises:

a second grounding portion fixed to the second outer lateral surface of the metal casing; and two fourth radiating portions connected to the second grounding portion and arranged in a symmetric manner;

wherein the second feeding point is located on one of the two fourth radiating portions.

11. The network monitoring device according to claim 10, wherein one of the two fourth radiating portions comprises:

a fifth radiating portion outwards extending from the second grounding portion in a first direction;

a sixth radiating portion extending from the fifth radiating portion in a second direction; and a seventh radiating portion extending from the sixth radiating portion in a third direction;

wherein the other one of the two fourth radiating portions comprises:

a fifth radiating portion outwards extending from the second grounding portion in the first direction;

a sixth radiating portion extending from the fifth radiating portion in a fourth direction; and a seventh radiating portion extending from the sixth radiating portion in the third direction;

wherein the second direction and the first direction are substantially perpendicular to each other, the first direction and the third direction are inverse to each other, the second direction and the fourth direction are inverse to each other, and the second feeding point is located on the fifth radiating portion of one of the two fourth radiating portions.

12. The network monitoring device according to claim 1, wherein the first feeding point is located on the first outer lateral surface of the first antenna, and the network monitoring device further comprises: a first feeding line extending to the interior of the metal casing from the first feeding point.

* * * * *